United States Patent [19]

Bowman

[11] 4,170,778

[45] Oct. 9, 1979

[54] FREQUENCY-SCANNED ANTENNA

[75] Inventor: David F. Bowman, Moorestown, N.J.

[73] Assignee: RCA Corporation, New York, N.Y.

[21] Appl. No.: 924,559

[22] Filed: Jul. 14, 1978

[51] Int. Cl.[2] ..... H01Q 13/10

[52] U.S. Cl. ..... 343/771; 343/768; 343/854

[58] Field of Search ..... 343/767, 768, 770, 771, 343/853, 854, 777, 756

[56] References Cited

U.S. PATENT DOCUMENTS

| | | | |
|---|---|---|---|
| 2,878,472 | 3/1959 | Sterns | 343/853 |
| 3,324,475 | 6/1967 | Milne | 343/777 |

OTHER PUBLICATIONS

Skolnik, Merrill I., *Radar Handbook,* New York: McGraw Hill, pp. 13-10 through 13-16.

*Primary Examiner*—David K. Moore

*Attorney, Agent, or Firm*—H. Christoffersen; Joseph D. Lazar

[57] ABSTRACT

A ridged rectangular launching waveguide and a ridged rectangular radiating waveguide have a common length-wise wall comprised of wall segments. A wave launched at the proximal end of the launching waveguide is coupled to the radiating waveguide through passageways between the segments. A cylindrical metal rod extends through a segment to the wavepaths of the waveguides. Additionally, the ridges of the waveguides have similar notches near the rod, the rod and the notches forming similar attenuators in the wavepaths. The passageways result in a formation of a pair of three-db, ninety-degree hybrids connected back-to-back through the attenuators. The hybrids and the attenuators couple a predetermined percentage of the energy of the wave to a radiating slot in a panel at the distal end of the radiating waveguide. The remainder of the wave energy is reflected by the attenuators and coupled by the hybrids through the radiating waveguide towards the proximal end thereof.

9 Claims, 7 Drawing Figures

FREQUENCY-SCANNED ANTENNA

The Government has rights to this invention pursuant to Contract No. DASG60-76-C-0075, awarded by the Department of the Army.

BACKGROUND OF THE INVENTION

1. Field of Invention

This invention relates to microwave antennas and more particularly to a frequency-scanned antenna.

2. Description of the Prior Art

A frequency-scanned antenna is typically comprised of a waveguide bent in the shape of a serpentine such that the antenna has a plurality of bends on its left side and a plurality of corresponding bends on its right side. Moreover, the displacements between the corresponding bends are equal. A plurality of radiators are usually connected to the bends on one side in a manner that prevents the waveguide form occluding the radiators. Since the radiators are connected to the bends on one side and the displacements between the corresponding bends are equal, the radiators are evenly spaced along the length of the waveguide.

The scanning aspects of the antenna are predicated upon the electrical length (wavelengths) of the waveguide being a function of the frequency of a wave that propagates through the waveguide. In other words, the waveguide is a delay line that has an electrical length which is a function of the frequency of applied excitation.

Typically, the excitation is applied to an input end of the waveguide thereby providing to the radiators respective signals that each comprise a predetermined percentage of the excitation. When the excitation has a frequency which is a function of time, the signals all have phase angles which are functions of time. The signals cause the radiators to provide radiation that combines to form a beam with a pointing angle which is a function of time. The antenna described hereinbefore is of a type which is the subject matter of pages 13-10 through 13-16 of "Radar Handbook" by Merrill I. Skolnik, published by McGraw Hill Book Company.

The antenna generally comprises a multiplicity of expensive, machined components that are difficult to assemble. Additionally, the components cannot be assembled to be mechanically rugged enough to survive an atomic blast at a hardened missile site, for example.

Frequency-scanned antennas that are inexpensive, reliable, easily assembled and mechanically rugged have heretofore been unknown in the prior art.

SUMMARY OF THE INVENTION

According to the present invention, the proximal end of a rectangular launching waveguide is adapted to receive a wave that is launched towards the distal end thereof. Similar reactive attenuators that pass a predetermined percentage of an incident wave and reflect the remainder are respectively disposed within the wavepaths of the launching waveguide and a rectangular radiating waveguide, the waveguides having a common length-wise wall. Passageways through the common wall result in a formation of a pair of three-db, ninety-degree hybrids connected back to back through the attenuators that couple the predetermined percentage of the launched wave to a radiating element at the distal end of the radiating waveguide, the remainder being reflected and coupled through the radiating waveguide towards the proximal end thereof.

DETAILED DESCRIPTION

Figure 1:
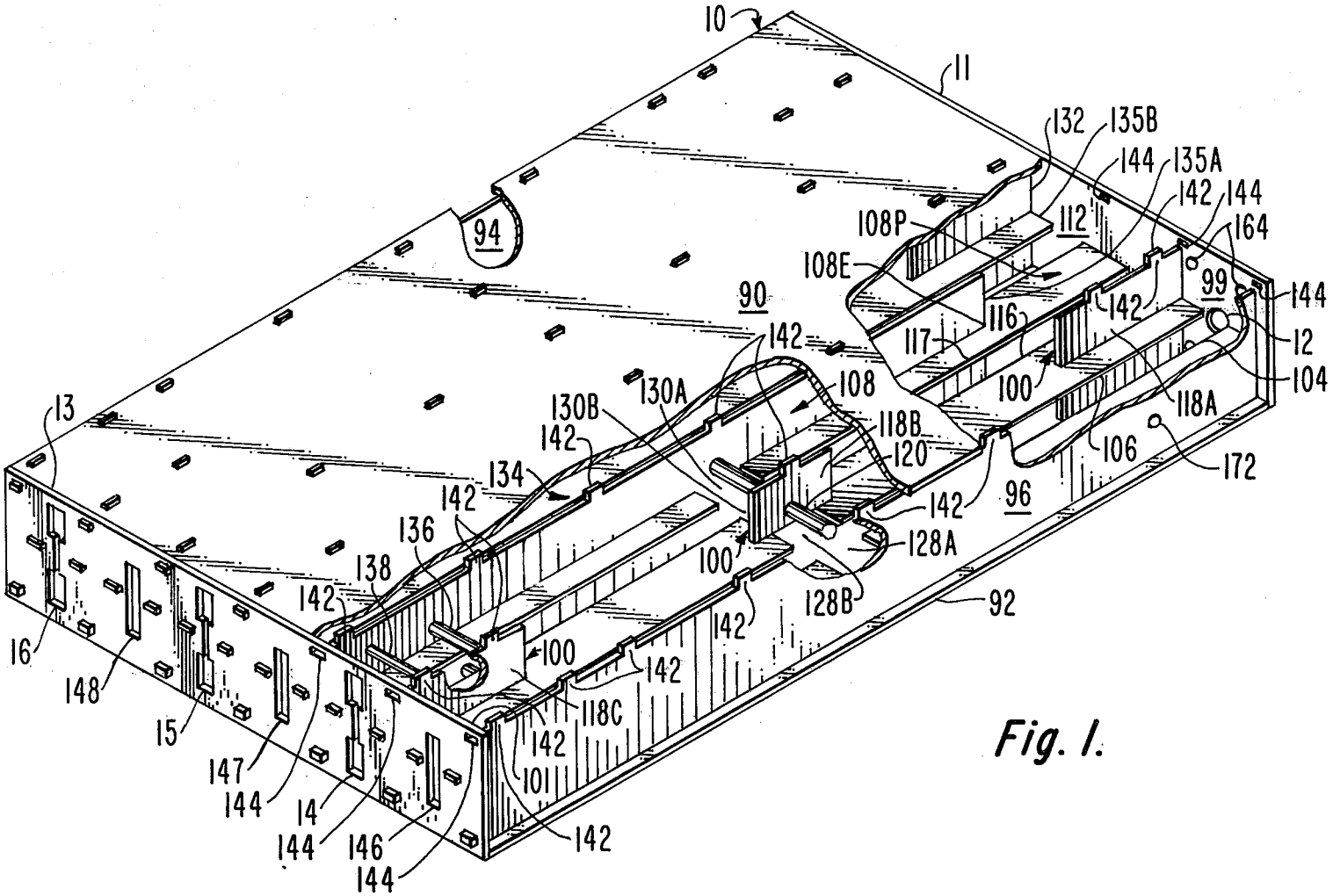
FIG. 1 is a perspective view, with parts broken away, of an exemplary embodiment of the present invention.

As shown in FIG. 1, in an exemplary embodiment of the present invention, a frequency-scanned antenna 10 has rear panel 11 parallel to a front panel 13, both of which are made from an electrically conductive material. Panel 11 has an input port 12 where an input wave may be launched. Panel 13 has slots 14, 15 and 16 that comprise radiators of antenna 10. As explained hereinafter, approximately one third of the input wave is radiated from each of slots 14, 15 and 16. In an alternative embodiment, a frequency-scanned antenna may, for example, have ten or more radiators. Moreover, the ten or more radiators may radiate portions of an input wave in accordance with the well known Taylor distribution, thereby achieving optimum side lobe suppression.

Figure 2:
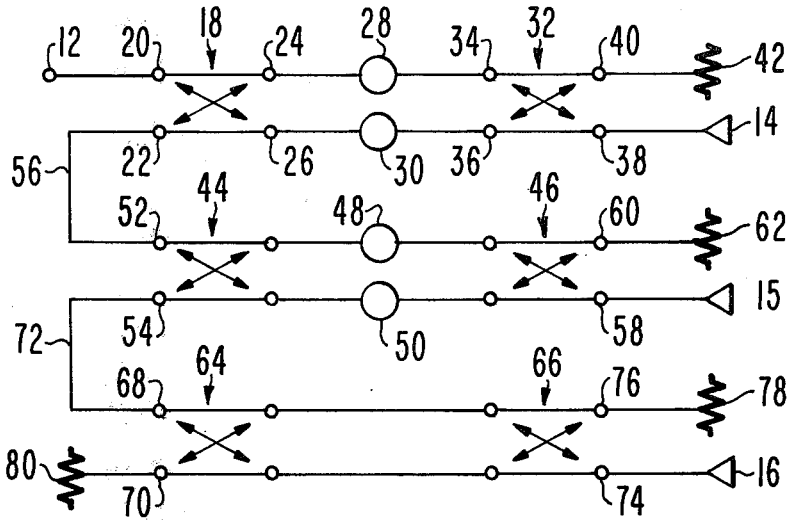
FIG. 2 is a schematic diagram of the embodiment of FIG. 1.

As shown in FIG. 2, a three-db, ninety-degree hybrid 18 has first quadrature terminals 20 and 22 and second quadrature terminals 24 and 26, terminal 20 being coupled to input port 12. Therefore, an input wave is directly coupled from port 12 to terminal 20.

In response to the input wave, hybrid 18 makes available at terminal 24 approximately one half of the energy of the input wave; the other half is available at terminal 26, whereby the energy available at terminal 24 substantially equals the energy available at terminal 26. Moreover, a signal at terminal 26 has a phase lead of ninety degrees with respect to a signal at terminal 24.

Terminals 24 and 26 are coupled to similar reactive attenuators 28 and 30, respectively. Attenuators 28 and 30 are selected to reflect two thirds of incident wave energy and pass one third of the incident wave energy. Because of attenuators 28 and 30 and the phase angles of the signals at terminals 24 and 26, two thirds of the input wave energy is reflected from attenuators 28 and 30 and coupled through hybrid 18 to terminal 22. There is substantially no coupling of the reflected two thirds of the input wave energy to terminal 20. As explained hereinafter, almost all of the two thirds of the input wave energy is provided to slots 15 and 16.

Attenuators 28 and 30 are coupled to a three-db, ninety-degree hybrid 32 at first quadrature terminals 34 and 36 thereof, whereby hybrids 18 and 32 are connected back to back through attenuators 28 and 30. Therefore, the one third of the input wave energy passed through attenuators 28 and 30 is provided to terminals 34 and 36. Since the energy available at terminal 24 substantially equals the energy available at terminal 26 and attenuators 28 and 30 are similar, the portion of the input wave energy provided to terminal 34 substantially equals the portion of the input wave energy provided to terminal 36. Hybrid 32 additionally has second quadrature terminals 38 and 40 connected to slot 14 and a load 42, respectively.

Similar to the signals at terminals 24 and 26, a signal at terminal 36 has a phase lead of ninety degrees with respect to a signal at terminal 34. Because of the ninety degree phase lead, the one third of the input wave energy passed through attenuators 28 and 30 is applied to slot 14 via terminal 38.

As known to those skilled in the art, there may be a mechanical imperfection in the structure of antenna 10 that causes a small portion of the input wave energy to be provided at terminal 40. Power associated with the small portion of the input wave energy provided at terminal 40 is dissipated by load 42.

Similar to hybrids 18 and 32, three-db, ninety-degree hybrids 44 and 46 are connected back to back through similar reactive attenuators 48 and 50. Hybrid 44 has first quadrature terminals 52 and 54, terminal 52 being coupled to terminal 22 through a 180-degree bend 56, whereby the reflected two thirds of the input wave energy coupled to terminal 22 is provided to terminal 52.

Attenuators 48 and 50 are selected to reflect one half of incident wave energy and pass one half of incident wave energy. Since two thirds of the input wave energy is provided to terminal 52, one third of the input wave energy is reflected from attenuators 48 and 50 and coupled through hybrid 44 to terminal 54 for reasons similar to those given in connection with attenuators 28 and 30 and hybrid 24. Additionally, one third of the input wave energy is passed through attenuators 48 and 50 and provided at second quadrature terminals 58 and 60 of hybrid 46.

Analogous to hybrid 32, terminals 58 and 60 are respectively coupled to slot 15 and a load 62. Therefore, the one third of the input wave energy passed by attenuators 48 and 50 is applied to slot 15 via terminal 58. Load 62, similar to load 42, dissipates any portion of the input wave energy provided at terminal 60.

Similar to hybrids 18 and 32, three-db, ninety-degree hybrids 64 and 66 are connected back to back. Although the connection of hybrids 64 and 66 is not through reactive attenuators in this embodiment, the connection may be through reactive attenuators in an alternative embodiment.

Hybrid 64 has first quadrature terminals 68 and 70, terminal 68 being connected to terminal 54 through a 180-degree bend 72 similar to bend 56 referred to hereinbefore, whereby the one third of the input wave energy reflected from attenuators 48 and 50 is provided to terminal 68.

Analogous to hybrid 32, hybrid 66 has second quadrature terminals 74 and 76 respectively coupled to slot 16 and to a load 78. Therefore, one third of the input wave energy is applied to slot 16 via terminal 74. Load 78, similar to load 42, dissipates any portion of the input wave energy provided at terminal 76. Similarly, terminal 70 is coupled to a load 80 to dissipate any portion of the input wave energy provided at terminal 70 because of a mechanical imperfection. From the description given hereinbefore, it is seen that the main path of the input wave energy is from input port 12, through hybrids 18, 44, 64 and 66.

Figure 3:
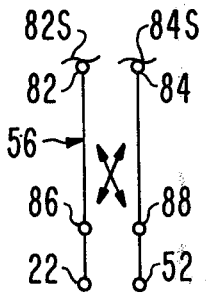
FIG. 3 is a schematic diagram of a bend in the embodiment of FIG. 1.

As shown in FIG. 3, bend 56 is a three-db, ninety-degree hybrid having second quadrature terminals 82 and 84 that are short circuited by terminations 82S and 84S, respectively. Terminations 82S and 84S cause an incident wave passed to terminals 82 and 84 to be reflected therefrom. Bend 56 additionally has first quadrature terminals 86 and 88 respectively coupled to terminals 22 and 52, whereby the reflected two thirds of the input wave coupled to terminal 22 is provided to terminal 52 as stated hereinbefore.

It should be understood that hybrids 34, 46 and 66 are non-reactive feed elements that do not couple slots 14–16 to each other. An undesired reflection from any of slots 14–16 is either dissipated in loads 42, 62, 78 and 80 or reflected back to the main path of the input wave energy. Because hybrids 34, 46 and 66 are non-reactive, tolerances on the components of antenna 10 are less critical than in frequency-scanned antennas of the prior art.

Referring back to FIG. 1, antenna 10 has the general shape of a rectangular parallelepiped with a top wall 90 parallel to a bottom wall 92, walls 90 and 92 being perpendicular to panels 11 and 13. Additionally, antenna 10 has side walls 94 and 96. Side wall 96 is parallel to a segmented length-wise wall 100 disposed within antenna 10. It should be understood that walls 90, 92, 94, 96 and 100 are all made from an electrically conductive material.

Figure 4:
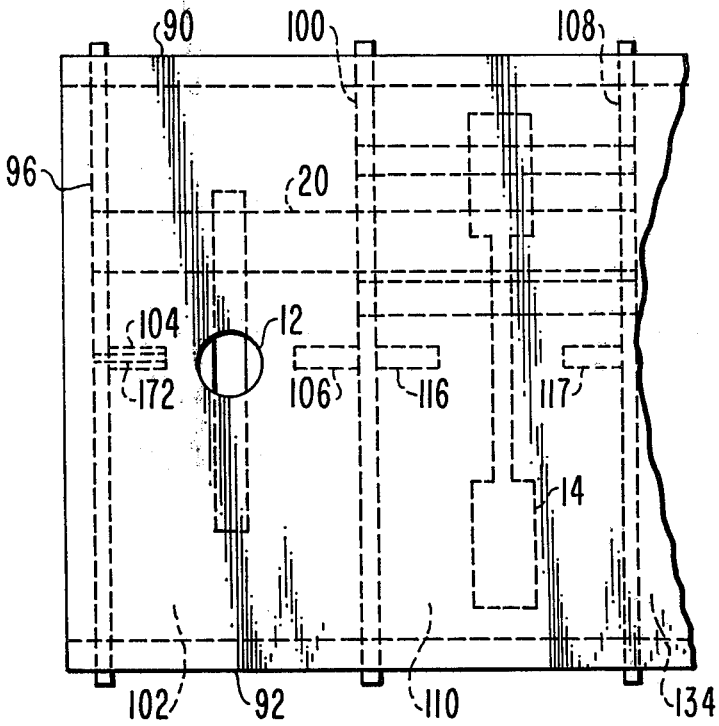
FIG. 4 is a rear elevation of a portion of the embodiment of FIG. 1.

As shown in FIG. 4, walls 90, 92, 96 and 100 define a rectangular launching waveguide 102. Moreover, panels 11 and 13 include the distal end 99 (FIG. 1) and proximal end 101, respectively, of waveguide 102.

Walls 96 and 100 include ridges 104 and 106, respectively, (FIGS. 1 and 4) which are parallel to walls 90 and 92. Ridges 104 and 106 are substantially midway between walls 90 and 92. As known to those skilled in the art, ridges 104 and 106 decrease the minimum displacement between walls 90 and 92 for supporting the propagation of a wave through waveguide 102. Therefore, ridges 104 and 106 and similar ridges referred to hereinafter, allow for antenna 10 to be of reduced or decreased volume as compared to an antenna without such ridges.

A wall 108 within antenna 10 is parallel to walls 96 and 100, whereby walls 90, 92, 100 and 108 define a radiating waveguide 110, wall 100 being common to waveguides 102 and 110. It should be understood that wall 108 is made from an electrically conductive material.

Similar to waveguide 102, panels 11 and 13 include the distal end 112 and the proximal end 114, respectively, of waveguide 110. Moreover, waveguide 110 has ridges 116 and 117 similar to ridges 104 and 106 described hereinbefore.

Figure 5:
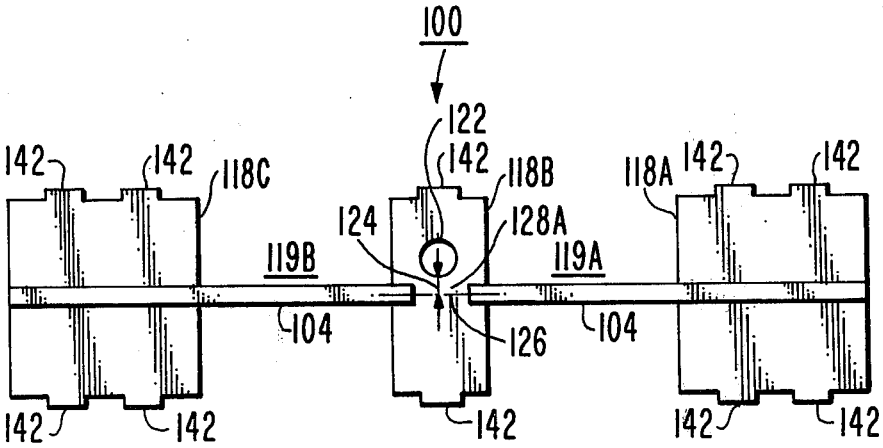
FIG. 5 is a side elevation of a segmented wall in the embodiment of FIG. 1.

As shown in FIG. 5, wall 100 is comprised of segments 118A–118C. Hybrid 18 (FIG. 2) results from a first passageway 119A between segments 118A and 118B that connects the cavities of waveguides 102 and 110 (FIG. 4). Similarly, hybid 32 results from a second passageway 119B between segments 118B and 118C that also connects the cavities of waveguides 102 and 110.

A cylindrical metal rod 120 (FIG. 1) extends through a hole 122 (FIG. 5) in segment 118B and is fixedly connected therein. Hole 122 has a displacement 124 from the center line 126 of segment 118B. Ends of rod 120 are fixedly connected to walls 96 and 108 in a manner that maintains the axis of rod 120 parallel to walls 90 and 92 and perpendicular to segment 118B.

Ridges 104 and 106 have similar opposed notches 128A and 128B, respectively (FIG. 1), notch 128A being near center line 126. Rod 120 and notches 128A and 128B form attenuator 28 (FIG. 2).

Correspondingly, ridges 116 and 117 have opposed notches 130A and 130B that are similar to notches 128A and 128B. Moreover, notches 130A and 130B have a spatial relationship to rod 120 and segment 118B that mirrors the spatial relationship of notches 128A and 128B to rod 120 and segment 118B. Rod 120 and notches 130A and 130B form attenuator 30 (FIG. 2). It should be understood that the transmission and reflection characteristics of attenuators 28 and 30 are determined by displacement 124.

A segmented wall 132 (FIG. 1), similar to wall 100, is parallel to wall 108, whereby walls 90, 92, 108 and 132 define a launching waveguide 134 similar to waveguide 102. Wall 132 is common to waveguide 134 and an adjacent radiating waveguide (not shown) which is similar to waveguide 110. Hybrids 44 and 46 are a result of passageways between segments of wall 132 that connect the cavities of waveguide 134 and the adjacent radiating waveguide. Hybrids 64 and 66 are a result of passageways formed in a manner similar to those formed by the segments of wall 132.

Wall 108 extends from wall 94 to a location 108E, whereby a passageway 108P is formed between the cavities of waveguides 110 and 132. Passageway 108P forms bend 56 (FIG. 3). Bends 72 and 80 are formed in a similar manner.

Cylindrical rods 136 and 138 are fixedly connected to wall 108 and segment 118C (FIG. 1) above ridges 116 and 117. Moreover, rods 136 and 138 are axially parallel to rod 120. Additionally, a rod 140 is connected to segment 118C below ridge 116. In this embodiment, rod 140 extends approximately midway between segment 118C and wall 108. Rods 136, 138 and 140 provide a substantially matched impedance between waveguide 110 and free space via slot 14.

Wall 96 (FIG. 1), wall 94, and all of the walls interior to antenna 10 have tangs 142 that mate with slots 144 in walls 90, 92 and panels 11 and 13. Tangs 142 are fused into the material near slots 144 in a dip brazing operation thereby providing a ridged monolithic assembly suitable for withstanding a blast at a nuclear missile site.

It should be appreciated that loads 42, 62, 78 and 80 (FIG. 2) may be damaged by heat caused by the fusing. Therefore, loads 42, 62, 78 and 80 are installed within antenna 10 after the dip brazing operation. Loads 42, 62, and 78 are installed through slots 146–148, respectively, in panel 13 (FIG. 1). Slots 146–148 are made as small as practical to prevent a structural weakening of panel 13.

Figure 6:
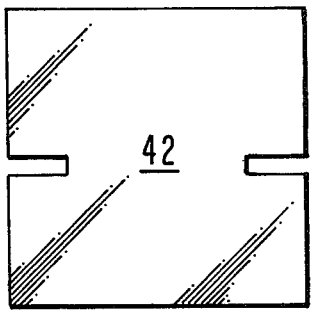
FIG. 6 is a plan view of a load suitable for installation in the embodiment of FIG. 1.

As shown in FIG. 6, load 42 (FIG. 2), exemplary of all of the loads included in this embodiment, is approximately 0.45 centimeters thick and is comprised of resilient silicon rubber loaded with resistive and magnetic lossy filler. Moreover, load 42 is cut to fit end 101 (FIG. 1). Load 42 is mounted in an abutting relationship with panel 13. A slot (not shown), similar to slots 146–148, is in panel 11 to provide for installation of load 80 (FIG. 2).

Figure 7:
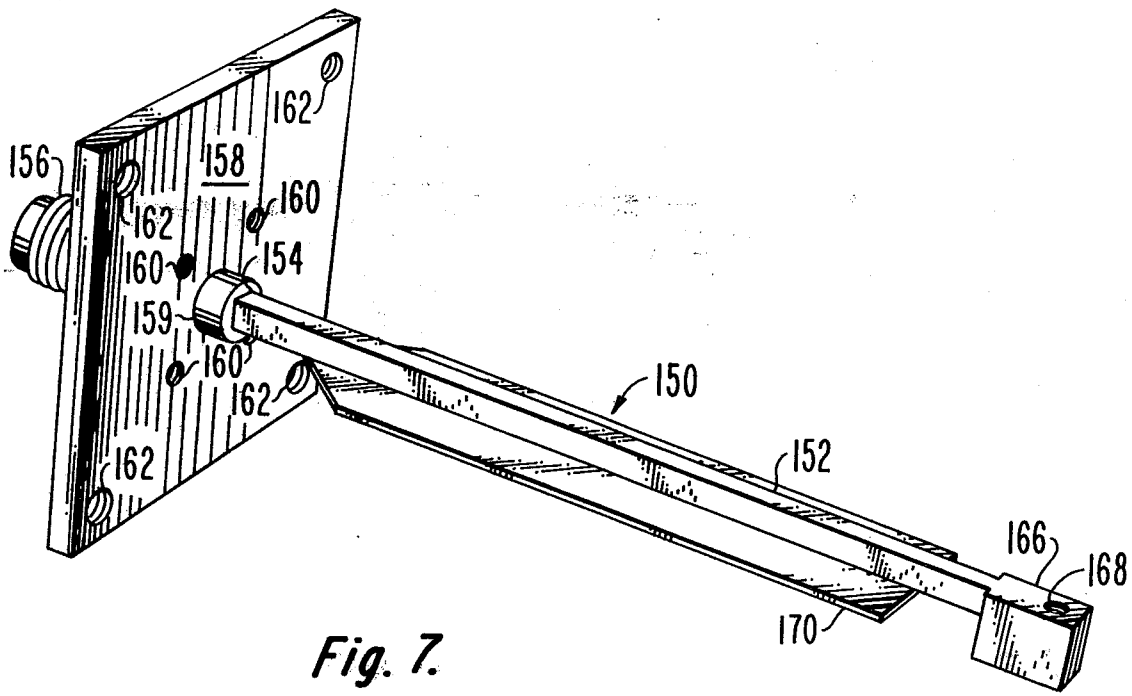
FIG. 7 is a perspective view of a launcher installed in the embodiment of FIG. 1 during assembly thereof.

As shown in FIG. 7, after the dip brazing operation, a launcher 150 is inserted in waveguide 102 (FIG. 4) through port 12. Launcher 150 includes a rod 152 that has a length of approximately one quarter of a wavelength of the input wave energy and has a square cross section. The proximal end 154 of rod 152 is carried within a connector 156 that has a bushing 159 that extends through a hole in a mounting plate 158. Bushing 159 is journalled within port 12.

A flange (not shown) of connector 156 is fastened to plate 158 by screws through threaded holes 160. Similarly, plate 158 is fastened to panel 11 by screws through holes 162 in plate 158 and corresponding holes 164 (FIG. 1) in panel 11.

Distal end 166 of rod 152 is enlarged and has a threaded hole 168 therein. Additionally, a blade 170 is fastened to a surface of rod 152, the plane of blade 170 being substantially orthogonal to the axis of hole 168.

When launcher 150 is inserted through port 12, distal end 166 contacts the edge of ridge 104 (FIG. 1). Moreover, hole 168 is contiguous with a threaded hole 172 (FIGS. 1 and 4) that passes through wall 96 and ridge 104. Additionally, blade 150 is substantially midway between ridges 104 and 106 and perpendicular thereto. Distal end 166 is fastened to ridge 104 by a screw (not shown) within holes 168 and 172.

Connector 156 is connected to a coaxial line (not shown). When excitation is applied to connector 156 via the coax, a coaxial mode of propagation of the input wave energy is established along rod 152. However, because end 164 is maintained in contact with ridge 104, the input wave energy propagates in the fundamental waveguide mode through waveguide 102.

Thus, there is shown hereinbefore a frequency scanned antenna where a radiating waveguide and a launching waveguide with similar attenuators in their wavepaths are separated by a segmented common wall. A wave launched at the proximal end of the launching waveguide is coupled to the radiating waveguide via passageways between the segments. A predetermined percentage of the energy of the wave is coupled to a slot in a wall at the distal end of the radiating waveguide, the remainder being reflected by the attenuator and coupled to the proximal end of the radiating waveguide.

What is claimed is:

1. A frequency-scanned antenna of the type that provides a desired percentage of input wave energy to each of a plurality of radiating elements, the improvement comprising:

a rectangular radiating waveguide having one of said radiating elements connected to its distal end;

a rectangular launching waveguide coupled to said radiating waveguide via passageways through a length-wise common segmented wall, the proximal end of said launching waveguide being adapted to have said input wave energy launched towards the distal end thereof; and first and second similar reactive attenuators that pass a known percentage of said input wave energy and reflect the remainder, said first and second attenuators being respectively disposed in the wavelengths of said radiating and launching waveguides, said passageways forming a pair of three-db, ninety-degree hybrids connected back to back through said attenuators that cause said known percentage of said input wave energy to be coupled to said one radiating element and the remainder to be coupled to the proximal end of said radiating waveguide.

2. The antenna of claim 1 wherein said one radiating element is a slot in a panel.

3. The antenna of claim 1 wherein said attenuators are a cylindrical metal rod that extends perpendicularly through said segmented wall.

4. The antenna of claim 1 wherein said waveguides each have similar opposed ridges.

5. The antenna of claim 4 wherein all of said ridges have similar notches and said attenuators are a cylindrical metal rod that extends perpendicularlythrough said common wall adjacent said notches.

6. The antenna of claim 1 wherein said common wall has a tang that mates with a slot in a top wall of said antenna.

7. The antenna of claim 1 additionally comprising a load mounted at the distal end of said launching waveguide.

8. The antenna of claim 1 wherein said launching waveguide has its proximal end connected to a panel with a port where said input wave is launched.

9. The antenna of claim 1 additionally comprising a rectangular radiating waveguide coupled to said launching waveguide via a passageway at the proximal ends thereof through a common wall parallel to said segmented wall.

* * * * *